US006023861A

United States Patent [19]

Bizzotto

[11] Patent Number: 6,023,861

[45] Date of Patent: Feb. 15, 2000

[54] ARCH SUPPORT FOR A SPORTS SHOE

[75] Inventor: Fide Bizzotto, Boynton Beach, Fla.

[73] Assignee: Calzaturificio S.C.A.A.P.A. SpA, Asolo, Italy

[21] Appl. No.: 09/136,005

[22] Filed: Aug. 17, 1998

[51] Int. Cl.[7] ..... A61F 5/14

[52] U.S. Cl. ..... 36/179; 36/171; 36/151; 36/43; 36/154

[58] Field of Search ..... 36/151, 152, 167, 36/168, 171, 174, 175, 176, 177, 178, 179, 43, 44, 154

[56] References Cited

U.S. PATENT DOCUMENTS

| | | | |
|---|---|---|---|
| 1,470,618 | 10/1923 | Craine | 36/179 |
| 1,527,371 | 2/1925 | Mullarky | 36/44 |
| 1,659,339 | 2/1928 | Vetterling | 36/44 |
| 1,920,383 | 8/1933 | Hadaway | 36/171 |
| 2,097,958 | 11/1937 | Uger | 36/180 |
| 2,140,464 | 12/1938 | Watts | 36/171 |
| 2,150,779 | 3/1939 | Nickerson | 36/182 |
| 2,156,086 | 4/1939 | Hack et al. | 36/171 |
| 2,713,732 | 7/1955 | Guest | 36/167 |
| 2,716,295 | 8/1955 | Stein | 36/168 |
| 3,244,177 | 4/1966 | Scholl | 36/154 |
| 4,571,857 | 2/1986 | Castellanos | 36/154 |
| 4,715,131 | 12/1987 | Kremendahl | 36/154 |

FOREIGN PATENT DOCUMENTS

| | | | |
|---|---|---|---|
| 243566 | 12/1925 | United Kingdom | 36/175 |

*Primary Examiner*—Paul T. Sewell
*Assistant Examiner*—J. Mohandesi
*Attorney, Agent, or Firm*—Charles E. Temko

[57] ABSTRACT

An arch support (1) for a sports shoe, in particular a mountaineering or hiking boot, having an anatomically shaped body (2) made of plastic material, and a reinforcing insert (3) embedded in the body (2); the insert (3) has a longitudinally ribbed structure, a main portion (10) extending along the sole of the foot and wide enough to impart a high degree of torsional rigidity to the arch support, and a narrow front appendix (11) extending from the main portion (10) and connected to the main portion substantially at the metatarsus.

2 Claims, 2 Drawing Sheets

ARCH SUPPORT FOR A SPORTS SHOE

The present invention relates to an arch support for a sports shoe, in particular hiking or mountaineering boots.

Arch supports are known which substantially comprise a body made of plastic material; and a metal reinforcing insert embedded in the body and normally defined by a fairly narrow metal blade of constant width and extending longitudinally with respect to the arch support body.

Known arch supports of the above type have several drawbacks.

In particular, the blade provides for poor torsional rigidity, thus impairing comfort and safety, especially over rough ground.

Moreover, flexural rigidity is constant along the whole of the insert, which may therefore be too rigid where a certain degree of bending is desired, e.g. at the metatarsus, while at the same time being too flexible elsewhere, thus resulting in permanent deformation, which is obviously to be avoided.

It is an object of the present invention to provide an arch support for a sports shoe, designed to eliminate the drawbacks typically associated with known arch supports of the aforementioned type.

According to the present invention, there is provided an arch support for a sports shoe, in particular a mountaineering or hiking boot, comprising a body made of plastic material, and a reinforcing insert embedded in the body; wherein said insert comprises a main portion extending along said body from a portion corresponding to the heel of the foot, up to the metatarsus; and an appendix extending frontwards from the main portion and smaller in width than the main portion.

In a preferred embodiment of the present invention, the insert comprises a longitudinally ribbed structure.

A preferred, non-limiting embodiment of the present invention will be described by way of example with reference to the accompanying drawings, in which.

Figure 1:
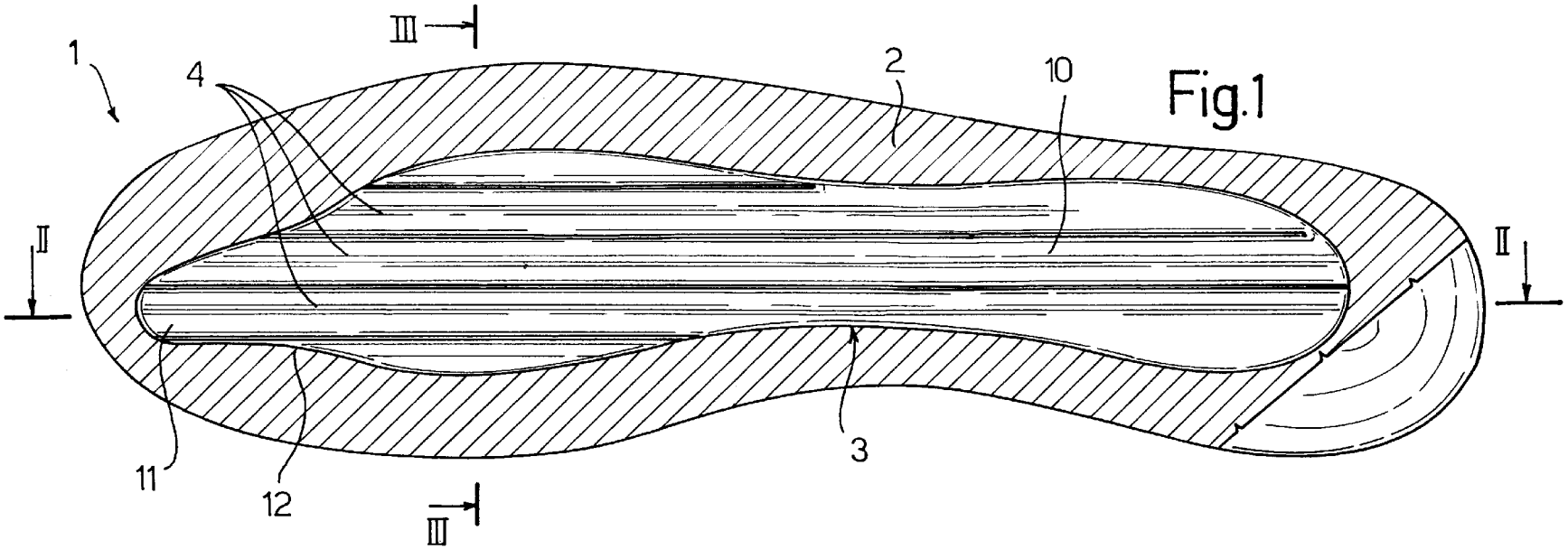
FIG. 1 shows a partially sectioned plan view of a first embodiment of an arch support in accordance with the present invention.
Figure 2:
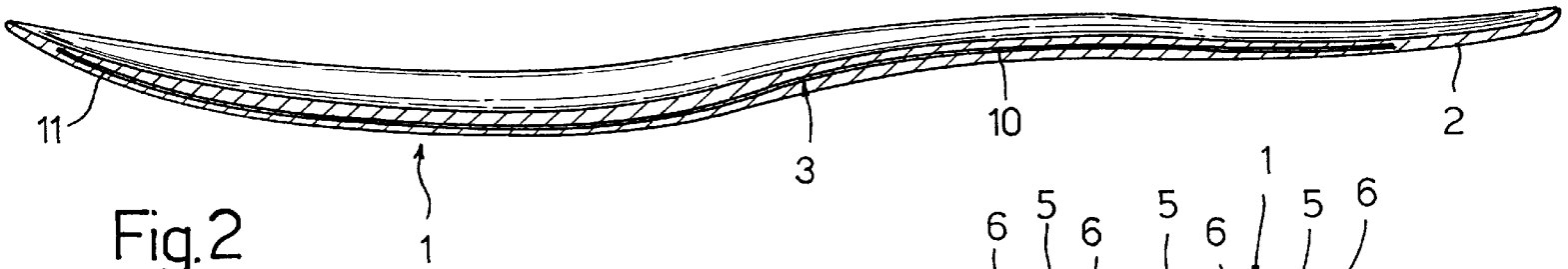
FIG. 2 shows a section along line II—II in FIG. 1.

Number 1 in FIG. 1 indicates as a whole an arch support for a hiking or mountaineering boot. Arch support 1 comprises an anatomically shaped body 2 made of plastic material; and a metal insert 3 embedded in body 2.

Figure 3:
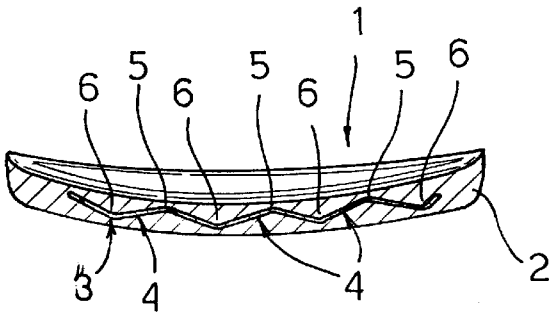
FIG. 3 shows a section along line III—III in FIG. 1.

More specifically, insert 3 is defined by a steel blade having a number of longitudinal ribs 4, in turn defined by a number of projections 5 and recesses 6 forming, in cross section (FIG. 3), a substantially undulated profile.

Insert 3 comprises a main portion 10 similar in shape to the sole of a foot, and extending from a portion of body 2 corresponding to the heel, up to the metatarsus; and a front appendix 11 extending from main portion 10 substantially at the hallux region. Front appendix 11 is narrower than main portion 10, and is connected to the main portion by a blend portion 12 substantially located at the metatarsus.

Figure 4:
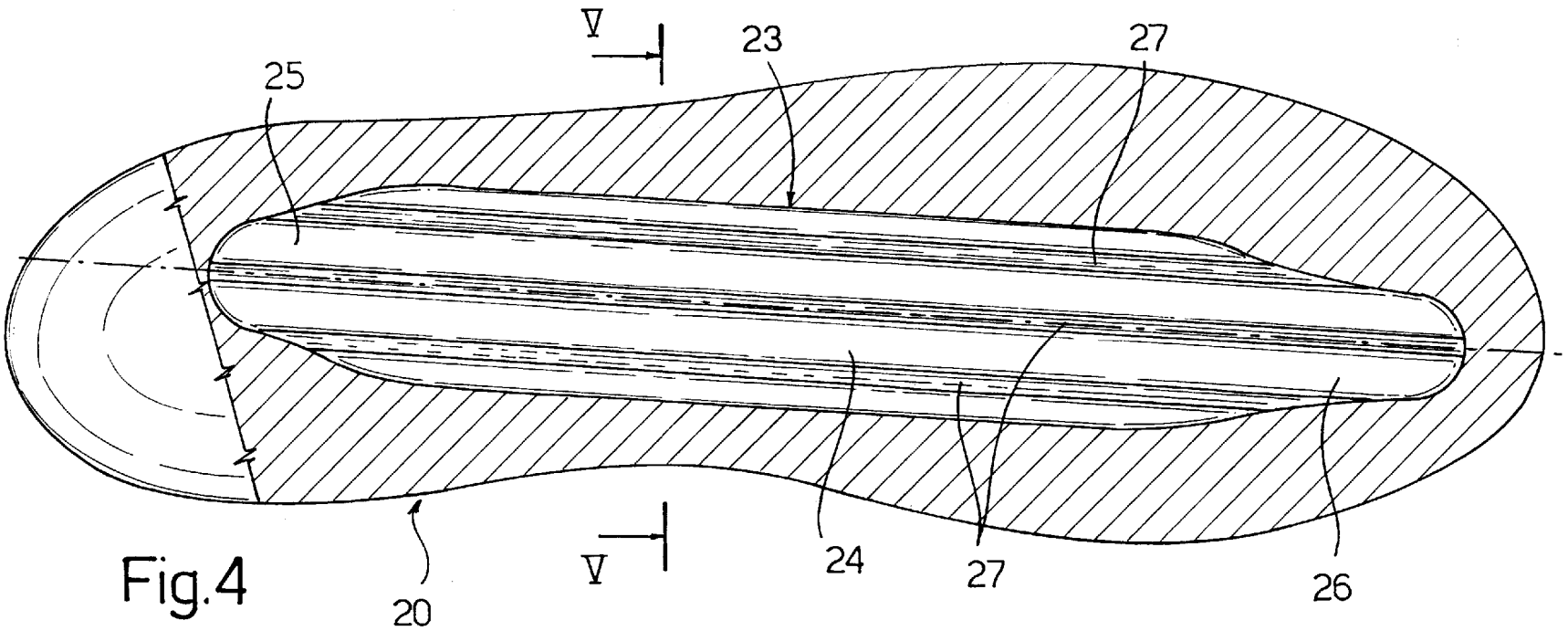
FIG. 4 shows a partially sectioned plan view of a second embodiment of the present invention.
Figure 5:
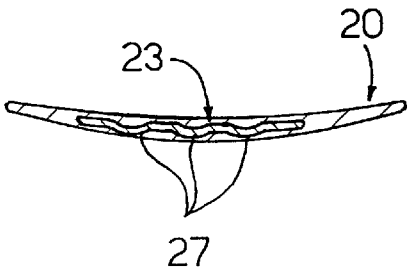
FIG. 5 shows a section along line V—V in FIG. 4.

FIGS. 4 and 5 show an arch support 20 according to a further embodiment of the invention.

Arch support 20 differs from arch support 1 by comprising an insert 23 which is symmetrical with respect to its own longitudinal center line, and which may therefore be used for producing arch supports for both right and left boots, with obvious advantages in terms of scale economy.

More specifically, insert 23 comprises a main portion 24 of constant width and having a rear portion 25 tapering at the heel; and front appendix 26 is narrower than main portion 24 and decreases gradually in width from the blend portion—located at the metatarsus—towards the tip of the arch support. Moreover, insert 23 comprises a number of longitudinal ribs 27 similar in shape to the ribs 4 of the insert 3.

The advantages of the arch supports according to the present invention will be clear from the foregoing description.

Insert 3, 23 provides for a high degree of torsional rigidity, by virtue of the fairly wide main portion 10, 24, and is narrower and therefore more flexible at front appendix 11, 26 to impart greater flexibility, in use, to the arch support at the metatarsus.

Moreover, the longitudinally ribbed structure of the insert provides for a high degree of flexural rigidity using a fairly thin and therefore lightweight insert.

Clearly, changes may be made to the arch supports as described and illustrated herein without, however, departing from the scope of the present invention. In particular, insert 3, 23 may be made of any suitable material, e.g. a composite carbon-fiber material.

Moreover, the blend portion between front appendix 11, 26 and main portion 10, 24 of insert 3, 23 may be shifted slightly to the front or rear, as required by the specific type of shoe; and the longitudinal ribs may be formed in any other way, or even dispensed with if a flat insert is sufficiently rigid.

I claim:

1. An arch support for a sports shoe comprising: a body of plastic material and a reinforcing insert imbedded in said body; said insert comprising a main portion extending along the body from a point corresponding to the heel of the foot up to the metatarsus, and an appendix extending forwardly from said metatarsus and smaller in width than said main portion; said insert being of metal and having a plurality of parallel longitudinal ribs forming an undulating profile, said ribs extending from said main portion continuously into said extension, whereby to form a yielding resistance as said support is flexed by a wearer.

2. The arch support set forth in claim 1, wherein said insert is symmetrical with respect to its own longitudinal center line.

* * * * *